US005922527A

United States Patent [19]

Barlow et al.

[11] Patent Number: 5,922,527

[45] Date of Patent: Jul. 13, 1999

[54] IMAGE TONERS FOR SILVER HALIDE PHOTOGRAPHIC FILMS

[75] Inventors: Charles G. Barlow, St. Paul; Richard R. Ollmann, Woodbury; Alexis S. Zinn-Warner, Maplewood, all of Minn.; Robert J. D. Nairne, Bishop's Stortford, United Kingdom; A. L. Beck, Hertford, United Kingdom; Andrew Mott, Bishop's Stortford, United Kingdom

[73] Assignee: Imation Corp., Oakdale, Minn.

[21] Appl. No.: 08/892,852

[22] Filed: Jul. 15, 1997

Related U.S. Application Data

[63] Continuation-in-part of application No. 08/680,377, Jul. 15, 1996, abandoned.

[51] Int. Cl.[6] ..... G03C 1/34; G03C 1/35

[52] U.S. Cl. ..... 430/611; 430/600; 430/603; 430/613; 430/965

[58] Field of Search ..... 430/611, 965, 430/613, 603, 600, 629, 630

[56] References Cited

U.S. PATENT DOCUMENTS

| | | |
|---|---|---|
| 2,298,093 | 10/1942 | Dersch . |
| 2,514,650 | 7/1950 | Knott et al. . |
| 4,551,419 | 11/1985 | Sugimoto et al. . |
| 4,695,535 | 9/1987 | Bryan et al. . |
| 4,728,601 | 3/1988 | Rowland et al. . |
| 4,818,675 | 4/1989 | Miyasaka et al. . |
| 5,013,641 | 5/1991 | Buntaine et al. . |
| 5,035,978 | 7/1991 | Barnett et al. . |
| 5,254,452 | 10/1993 | Sakuma . |
| 5,258,280 | 11/1993 | Suzuki . |

FOREIGN PATENT DOCUMENTS

| | | |
|---|---|---|
| 0 407 206 A1 | 1/1991 | European Pat. Off. . |
| 61-020026 | 1/1986 | Japan . |
| 63-301939 | 12/1988 | Japan . |
| 01217450 | 8/1989 | Japan . |
| 3271733 | 3/1990 | Japan . |
| 3153234 | 7/1991 | Japan . |
| 4294346 | 10/1992 | Japan . |

OTHER PUBLICATIONS

K. Futaki, Phot. Sci. & Eng. 4 (1960) 257.
W.E. Muller, Phot. Sci & Eng. 15 (1971) 369.
T.H. James, W. Vanselow, Phot. Sci. & Eng. 1 (1958) 104.
E. Weyde, Photogr. Korres. 98 (1962) 7.

*Primary Examiner*—Thorl Chea
*Attorney, Agent, or Firm*—William K. Weimer

[57] ABSTRACT

A black-and-white, negative-acting, silver halide emulsion is described which gives improved image tone when used in a photographic element. The toning agents are based on dithio-substituted compounds having the following general structures:

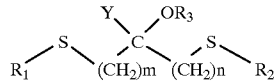

and

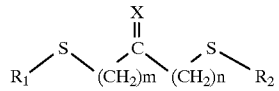

where $R_1$ and $R_2$, independently, are selected from the group consisting of alkyl, aryl and heterocyclic groups, or $R_1$ and $R_2$ together complete a ring;

n and m are integers from 1 to 5; Y is a hydrogen; $R_3$ is a hydrogen or alkyl group;

and X is selected from the group consisting of O, S, N—OH and N—$N(R)_2$, where R is a hydrogen or alkyl group.

19 Claims, No Drawings

IMAGE TONERS FOR SILVER HALIDE PHOTOGRAPHIC FILMS

This is a continuation-in-part of commonly assigned U.S. Ser. No. 08/680,377, filed Jul. 15, 1996 now abandoned.

FIELD OF THE INVENTION

The present invention relates to black and white silver halide photographic materials, in particular it relates to the addition of a toning agent to a fine-grained silver bromide emulsions to improve image tone.

BACKGROUND

The image tone of a developed silver halide layer describes the perceived color or tint of the nominally black filamentous silver. Depending on a number of factors, the image tone can be described as brown-black or blue-black, and changes in this image tone can be undesirable in certain imaging environments. Blue-black image tone is also variously known as a cold or hard tone, whereas a brown-black tone can be described as a warm, or soft, tone.

The tone of an image can be observed by reflectance or transmission of light, depending on the particular application or format of the imaging medium. In images for medical applications, particularly those produced from exposure by a laser imager, the image is most often viewed by light transmitted through the image, and hence the transmitted image tone is of great importance. The tone and consistency of the tone of a medical image are critical, given the large number of images that need to be viewed, and the limited time available for analysis of each image. The image tone needs to be optimized to provide acceptable image quality, with minimal eye strain on the viewer. To this end a blue-black image tone is highly desirable. At the same time as the tone is optimized, there should be no corresponding increase in the Dmin, or other significant change in sensitometry.

The image tone of a developed photographic emulsion depends on a number of factors, e.g., the silver halide grain size, the degree of gelatin hardening (see i.e., E. Weyde, *Photogr Korres.,* 1, 7 (1962)), and various processing parameters, such as the developer pH, the nature of the developing agent and the drying method (see i.e., T. H. James and W. Vanselow, *Photographic Science & Engineering,* 1, 104 (1958)). The image tone becomes progressively more yellow-brown with decreasing size of the silver particles within the image areas due to scattering of the blue component of the light. To overcome this undesirable shift in image tone, toning agents have traditionally been added to fine-grained photographic emulsions containing high levels of silver chloride in the grains. However, fine-grained emulsions of high silver bromide content (e.g., 50 to 100 mol % bromide) are difficult to tone.

The perceived image tone may also be modified through a variety of methods including the use of a highly blue-tinted base, the use of a dye-forming developer, or adaptation of the morphology of the developed silver. Of these, the latter is the preferred route, since flexibility in the type of support (clear or blue-tinted) is maintained. Dyes formed during development can be problematical, since they often have low stability. By changing the form of the filamentary silver produced during development, a permanent cold image tone can be constructed.

Several published papers have discussed the tone of developed silver halide emulsions. For example, the toning of silver chloride emulsions with various toning agents is described in K. Futaki, et al., *Photographic Science & Engineering,* 4, 257 (1960). The growth and nature of silver filaments in silver bromide emulsions is discussed in W. E. Muller, *Photographic Science & Engineering,* 15, 369 (1971). The effect of the developer on the form of silver filaments is mentioned in T. H. James, et al., *Photographic Science & Engineering,* 1, 104 (1958). Some factors affecting image tone, such as film hardness is described in E. Weyde, *Photogr. Korres.,* 98, 7 (1962).

U.S. Pat. No. 2,298,093 raises the issue of incorporating toning agents to silver bromide emulsions. Compounds containing the unit —C(=O)NHC(=S)Y— are disclosed as toners of silver bromide emulsions to impart a blue-black image. However, no description was given regarding how the tone was determined nor was any supportive data supplied.

U.S. Pat. No. 4,818,675 and JP 03-153234 have cited the use of blue leuco dyes to mask the warm image tone by imagewise production of a blue dye. The use of blue dyes in the emulsion layer to alter the visual impression of the image color have also been described in EP 0481651 and JP 03-271733. The disadvantage of these approaches are that they can lead to loss of speed and/or increase the optical density of the film in unexposed regions.

Others have disclosed the use of heterocyclic thiols or thiones (see i.e., JP 61-020026 and JP 63-015140). EP 0197895 describes the use of 2-alkylthio-tetrazaindenes as image toners in black and white paper products. Other silver coordinating species discussed in the art include macrocyclic sulfides (see i.e., JP 63-313939 which describes compounds containing at least 3 sulfur atoms, at least one carbon chain and at least one other divalent linking group).

Improvements in image tone have also been discussed in conjunction with a variety of silver grain emulsions. For example, U.S. Pat. Nos. 5,013,641 and 5,258,280 describe improvements of the image tone in tabular emulsions. JP 04-294346 discloses the use of mercaptooxadiazoles in emulsions of particle size 0.4 $\mu$m or less to improve the image tone. One of the examples uses a core-shell cubic silver chlorobromide emulsion of mean grain size 0.35 $\mu$m in combination with a mercaptooxadiazole which gives a blue-black image tone compared to the yellowish-black tone of the emulsion without the oxadiazole.

SUMMARY OF THE INVENTION

The present invention provides a black-and-white, negative-acting silver halide photographic emulsion comprising a toning agent having the following general formula I:

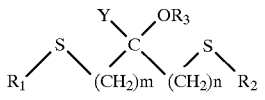

where $R_1$ and $R_2$, independently, are selected from the group consisting of alkyl, aryl and heterocyclic groups, or $R_1$ and $R_2$ together complete a ring; n is an integer from 1 to 5; m is an integer from 1 to 5; Y is a hydrogen; and $R_3$ is a hydrogen or alkyl group.

In another embodiment of the present invention, a black-and-white, negative-acting silver halide photographic emulsion is provided comprising a toning agent having the following general formula II:

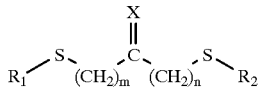

II where $R_1$ and $R_2$, independently, are selected from the group consisting of alkyl, aryl and heterocyclic groups, or $R_1$ and $R_2$ together complete a ring; n and m are integers from 1 to 5; and X is selected from the group consisting of O, S, N—OH and N—$N(R)_2$, where R is a hydrogen or alkyl group.

In yet another embodiment, a black-and-white, negative-acting photographic element is provided comprising a support having coated thereon at least one emulsion layer described above containing either the dithio-substituted compound having structure I or II.

As used herein, the term "group" refers to a chemical entity that may be substituted or unsubstituted. For example, an alkyl group includes simple, branched and cyclic alkyl species, such as methyl, ethyl, propyl, butyl, octyl, dodecyl, allyl, and stearyl. The alkyl groups may also include substitutents such as hydroxyl, cyano, amino, alkylamino, alkoxy, alkylthio, halogen and other substituents understood by one of ordinary skill in the photographic art to be within the range and type of substitution traditionally tolerated or desired. The term "moiety" or "species" refers only to the unsubstituted chemical material.

DETAILED DESCRIPTION OF THE INVENTION

The present invention provides dithio-substituted compounds which impart blue-black color to the developed image when incorporated into a silver bromide containing emulsion of a photographic element without adversely impacting the sensitometric properties (i.e., photographic speed, contrast, Dmin, and Dmax). The toners are particularly useful in changing the image tone of developed silver halide grains produced directly from wet development (as opposed to photothermography) in the absence of silver halide solvents.

Particularly useful dithio-substituted compounds are represented by the following two structures I and II.

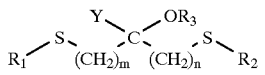

I where $R_1$ and $R_2$, independently, are selected from the group consisting of alkyl, aryl and heterocyclic groups, or $R_1$ and $R_2$ together complete a ring, preferably an 8–16 membered ring (e.g., 1,5-dithiacyclooctane and 1,5,9,13-tetrathiacyclohexadecane); n is an integer from 1 to 5; m is an integer from 1 to 5, preferably from 1 to 3; Y is a hydrogen; and $R_3$ is a hydrogen or an alkyl group having preferably no more than 5 carbon atoms.

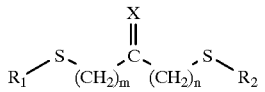

II where $R_1$ and $R_2$, independently, are selected from the group consisting of alkyl (e.g., methyl, ethyl, allyl, etc.), aryl (e.g., phenyl) and heterocyclic (e.g., thiophene, tetrahydrothiophen, furan, etc.) groups, or $R_1$ and $R_2$ together complete a ring, preferably an 8–16 membered ring (e.g., 1,5-dithiacyclooctane and 1,5,9,13-tetrathiacyclohexadecane); n and m are integers from 1 to 5, preferably from 1 to 3; and X is selected from the group consisting of O, S, N—OH and N—$N(R)_2$, where R is a hydrogen or alkyl group.

Representative examples of dithio-substituted compounds are listed in Table I.

TABLE 1

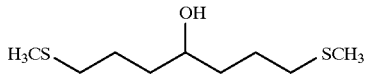

1

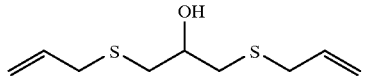

2

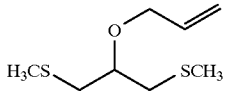

3

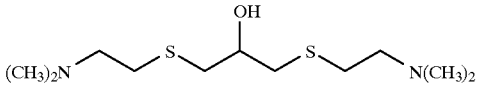

4

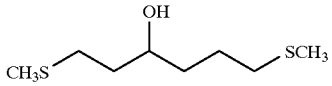

5

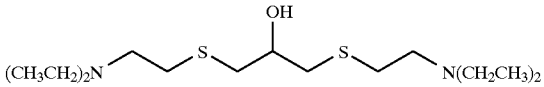

6

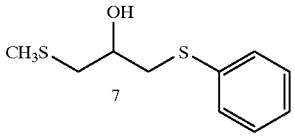

7

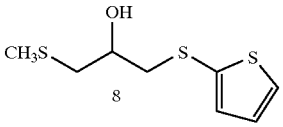

8

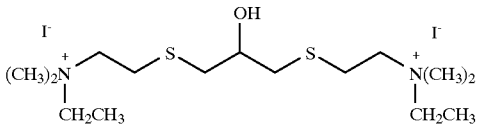

9

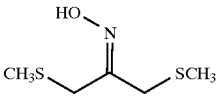

10

TABLE 1-continued

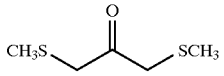

11

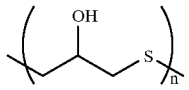

12

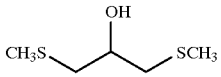

13

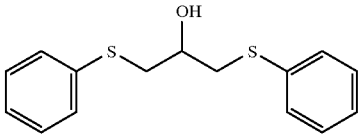

14

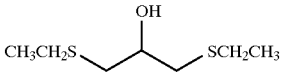

15

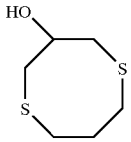

16

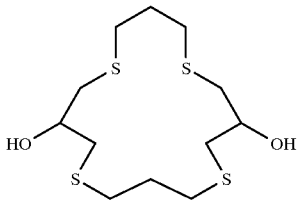

17

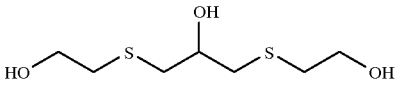

18

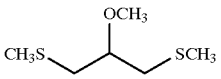

19

The relevant compounds are either commercially available or readily synthesized by conventional routes. Representative synthetic routes are described in the preparation section of the Examples.

The dithio-substituted compounds may be added to essentially any black-and-white, negative-acting silver halide emulsion (i.e., grains of silver chloride, silver bromide, silver chlorobromide, silver iodobromide, silver iodochloride, silver iodochlorobromide, or any combination thereof). The dithio-substituted compounds are particularly useful in emulsions with a high content of silver bromide, i.e., emulsions comprising at least 50 mole %, preferably at least 75 mole %, and most preferably from 85–100 mole % silver bromide. The grains may have a uniform or a layered (i.e., core-shell) structure. The mean edge length of at least 50% of the grains by number is generally less than 2.0 microns, preferably less than 1.0 micron and most preferably less than 0.4 micron.

The morphology of the silver halide grains is typically, but not limited to, the cubic or octahedral habits. Other suitable morphologies include tetrahedral, rhombododecahedral and icosatetrahedral, hexagonal, epitaxial, tabular or laminar grains, as well as mixtures of these shapes. Rounded grains and grains of less well defined shape are also envisaged. These emulsions are prepared by any of the well known procedures, e.g., single or double jet emulsions as described in U.S. Pat. Nos. 2,222,264; 3,320,069; 3,271,157; 4,425,425 and 4,425,426. During the emulsion preparation, additives such as metal ions (i.e., ions of rhodium, ruthenium or iridium) can be used to improve reciprocity behavior, or to further enhance contrast. The additives may display a concentration variation of any desired complexity along the radius of the grains.

The silver halide emulsions may be unwashed or washed to remove soluble salts by-products. In the latter case, the soluble salts can be removed by chill setting and leaching or the emulsion can be coagulation washed by procedures such as those described in U.S. Pat. Nos. 2,618,556; 2,614,928; 2,565,418; 3,241,969; and 2,489,341.

The emulsion can be prepared, washed, chemically and spectrally sensitized by any of the techniques well known to those skilled in the art. The photographic silver halide emulsions can contain other addenda conventional in the photographic art, such as main group metal ions; transition metal ions; chemical sensitizers such as compounds of sulfur, selenium, tellurium, gold, palladium and platinum.

The silver halide emulsions can be protected against the production of fog and stabilized against changes in sensitivity during storage by the addition of antifoggants and stabilizers alone or in combination. Suitable additives include the thiazolium salts described in U.S. Pat. Nos. 2,131,038 and 2,694,716; the azaindines described in U.S. Pat. Nos. 2,886,437 and 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No.623,448; nitron; nitroindazoles; the polyvalent metal salts described in U.S. Pat. No. 2,839,405; the thiuronium salts described in U.S. Pat. No. 3,220,839; and the palladium, platinum and gold salts described in U.S. Pat. Nos. 2,566,263 and 2,597,915.

The emulsion is usually spectrally sensitized using a dye which will enhance the sensitivity of the silver halide grains to the wavelength of the exposing device. For example, where a helium-neon laser is the output device, the emulsion can be spectrally sensitized to 633 nm; where an infrared laser diode is the output device the emulsion can be sensitized, for example, in the region of 720–900 nm. The emulsion may be used for continuous tone or half-tone image reproduction.

The silver halide emulsions can be dispersed in various hydrophilic colloids alone or in combination as vehicles or binding agents. Suitable hydrophilic materials include both naturally occurring substances such as proteins, gelatins derived from animal bones and hides by the acid or liming process and chemically modified gelatins (i.e., phthalated, succinylated), cellulose derivatives, polysaccharides (i.e., dextran, gum arabic); and synthetic substances, such as water soluble polyvinyl compounds (i.e., poly(vinyl pyrrolidone)), acrylamide polymers or other synthetic polymeric compounds such as dispersed vinyl compound in latex form, and particularly those that increase the dimensional stability of photographic materials. Suitable synthetic polymers include those described in U.S. Pat. Nos. 3,143,568; 3,193,386; 3,062,674; 3,220,844; 3,287,289; and 3,411,911. Preferred polymers are water insoluble polymers of alkyl (meth)acrylates, (meth)acrylic acid, sulfoalkyl (meth) acrylates, those which have cross linking site which facilitate hardening or curing and those having recurring sulfobetaine units such as those described in Canadian Patent No.774,054.

The photographic silver halide emulsions can be dispersed in colloids that may be hardened by various organic and inorganic hardeners, alone or in combination, such as the aldehydes, ketones, carboxylic and carbonic acid derivatives, sulfonate esters, sulfonyl halides, and vinyl sulfones, active halogen compounds, epoxy compounds, azridines, active olefins, isocyanates, carbodiimides, mixed function hardeners such as oxidized polysaccharides (i.e., dialdehyde starch and oxyguar gum).

The emulsions may be used in photographic elements which contain antistatic or conducting layers, such as layers that comprise soluble salts (i.e., chlorides, nitrates), evaporated metal layers, ionic polymers such as those described in U.S. Pat. Nos. 2,861,056 and 3,206,312 or insoluble inorganic salts such as those described in U.S. Pat. No. 3,428, 451.

The photographic emulsions may be coated on a wide variety of supports. Suitable supports include polyester film, subbed polyester film, poly(ethylene terephthalate or polyethylene naphthalate) film, cellulose ester film, poly(vinyl acetal) film, polycarbonate film, and related resinous materials, as well as glass, metal and paper. Typically, a flexible support is employed. Suitable paper supports may be partially acetylated or coated with baryta and /or an alpha-olefin polymer, particularly a polymer of an alpha-olefin containing 2 to 10 carbon atoms such as polyethylene, polypropylene, and ethylene-butene copolymers.

The emulsions may contain plasticizers and lubricants such as polyalcohols such as glycerin and diols of the type described in U.S. Pat. No. 2,960,404; fatty acids or esters such as those described in U.S. Pat. Nos. 2,588,765 and 3,121,060; and silicone resins such as those described in British Patent No. 955,061.

The photographic emulsions as described herein may contain surfactants such as saponin, anionic compounds such as the alkylarylsulfonates described in U.S. Pat. No. 2,600,831, fluorinated surfactants, and amphoteric compounds such as those described in U.S. Pat. No. 3,133,816.

Photographic elements containing emulsion layers as described herein may contain matting agents such as starch, titanium dioxide, silica, zinc oxide, polymeric beads such as those described in U.S. Pat. Nos. 2,992,101 and 2,701,245.

The silver halide emulsions may be utilized in photographic elements which contain brightening agents including stilbene, triazine, oxazole and coumarin brightening agents. Suitable water soluble brightening agents include those described in German Patent No. 927,067 and U.S. Pat. No. 2,933,390 or dispersions of brighteners such as those described in German Patent No. 1,150,274 and U.S. Pat. No. 3,406,070.

Photographic elements containing emulsion layers according to the present invention may also contain light absorbing materials and filter dyes such as those described in U.S. Pat. Nos. 3,253,921; 2,274,782; 2,257,583 and 2,956,879. If desired, the dyes may be mordanted (see i.e., U.S. Pat. No. 3,282,699).

The photographic emulsions may be coated by a variety of coating procedures including dip coating, air knife coating curtain coating, or extrusion coating using hoppers of the type described in U.S. Pat. No. 2,681,294. Two or more layers may be coated simultaneously by the procedures described in U.S. Pat. No. 2,761,791 and British Patent No. 837, 095.

Other conventional photographic addenda such as coating aids, spectral sensitizers, antistatic agents, acutance dyes, antihalation dyes, antifoggants, stabilizers, latent image stabilizers, antikinking agents, lubricating agents, matting agents and the like may also be present.

Typically, the toning compounds are added just before the coating of the emulsion layers. One or more toning agents may be added to the emulsion to provide the best improvement in image tone.

Preferably the toning agents are incorporated into the emulsion at levels of between 0.001 and 10 g/mole Ag; especially preferred, between 0.1 and 1 g/mole Ag. Any suitable solvent may be used to dissolve the compound, e.g. water, methanol, ethanol, acetone, DMSO and DMF. Alternatively, the toning agent may be added as a solid, a dispersion in an oil or other water immiscible liquid, a dispersion in a gelatin matrix, or by any of the other usual techniques familiar to one skilled in the Art. The quantity of toning agent may be varied to optimize the sensitometric properties (i.e., photographic speed, contrast, Dmin and Dmax) of the film.

The image tone of the exposed film can be measured using any suitable technique. One method of measuring the image tone is by determining the CIE color coordinates at an optical density of approximately 1. The b* coordinate represents the blue/yellow hue associated with the image color. Positive b* values indicate that the image has a yellow tone; whereas, negative b* values indicate a blue image tone. The compounds exemplified herein impart a change in b* of 0.5 or greater towards a more negative (blue) value.

The image tone described herein is the deviation from a neutral black caused exclusively by the developed silver halide grains. The overall perceived image tone consists of a number of constituents, such as the color of the base material and tint arising from the gelatin and other emulsion components, as well as from the developed grains. By using the unexposed regions as the reference when the tone is determined, these other contributions can be accounted for and eliminated from the measured image tone.

EXAMPLES

The following preparations provide representative examples of synthetic routes to the dithio-substituted compounds used in the Examples 1–4. Compounds 16 and 17 are available from Aldrich Chemicals (Milwaukee, Wis., USA). Compounds 13 and 19 are available from Lancaster Synthesis Ltd. (Morecambe, Lancashire, UK). Unless indicated otherwise, the chemicals listed in the preparations are available from Aldrich Chemicals. The following abbreviations were used for the respective chemical materials: MeOH=methanol; and DMF=dimethylformamide.

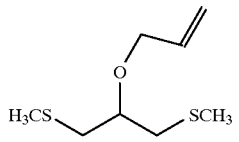

3

Preparation of2-allyloxy-1 3-bis(methylthio)propane (3)

1,3-Bis(methylthio)-2-propanol (3.02 g, 20 mmole) in dry THF was added dropwise to a stirred suspension of washed sodium hydride (1.02 g of a 60% dispersion in mineral oil, 22 mmole) in dry THF (50 mL) at 0° C. under nitrogen. Once the addition was complete, the mixture was stirred at this temperature for 30 minutes and then treated with allyl bromide (2.66 g, 22 mmole) by dropwise addition. The mixture was allowed to warm to room temperature and then stirred for 16 hours. The solvent was removed in vacuo and the residue partitioned between ether (50 mL) and water (50 mL). The organics were separated, dried, filtered and evaporated to give an orange oil that was purified by chromatography in 40–60 petroleum ether/ether (4/1) to give 3 (2.3 g, 60%) as a colorless oil.

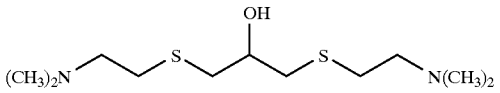

4

Preparation of 1,3-bis(2-(dimethylamino)ethylthio)-2-propanol (4)

2-(Dimethylamino)ethanethiol hydrochloride (10.78 g, 78 mmole) was added portion-wise to a solution of sodium hydroxide (6.2 g, 155 mmole) in ethanol (40 mL) at 0° C. under nitrogen. A further portion of ethanol (20 mL) was added and the mixture stirred at this temperature for 10 minutes. 1,3-Dichloro-2-propanol (5.29 g, 41 mmole) was added dropwise. On completion of the addition, the reaction mixture was allowed to warm to room temperature and stirred for a further 2 hours. The precipitated solid was filtered off and the washed with ethanol. The filtrate was evaporated. The resulting oil was taken up into acetone, filtered and evaporated to give the desired product (8.90 g, 68%) as a pale yellow oil.

Compounds 2, 6, 14, 15, and 18 were prepared using the same basic procedures described above by reaction of 2,3-dichloropropan-2-ol (available from Aldrich) with two equivalents of the appropriate thiol. Compound 11 was similarly prepared from 1,3-dichloroacetone.

Preparation of 1-chloro-3-methylthiopropane

Sodium methanethiolate (14 g, 200 mmole) was added portion-wise to a stirred solution of 1-iodo-3-chloropropane (40.88 g, 200 mmole) in ethanol. The mixture was stirred at room temperature for 64 hours. The solvent was removed in vacuo and the residue was partitioned between ether and water. The organics were separated, dried, filtered and evaporated to give a colorless oil that was purified by column chromatography in ether to give the desired material (9 g, 36%) as a colorless oil.

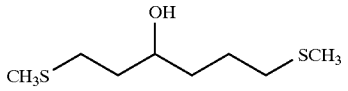

5

Preparation of 1,6-bis(methylthio)-3-hexanol (5)

1-Chloro-3-methylthiopropane (3.73 g, 30 mmole) in dry THF (50 mL) was added to stirred magnesium turnings (0.72 g, 30 mmole) under argon. Once the addition was complete, the mixture was heated to 50° C. for 3 hours. The mixture was then allowed to cool to room temperature and 3-methylthiopropanal (3.12 g, 30 mmole) was added. The reaction was stirred at room temperature for 1 hour. 2M ammonium chloride solution (50 mL) was added, followed by ether (50 mL). The organics were separated, dried, filtered, and evaporated to give a pale yellow oil that was purified by chromatography in 40–60 petroleum ether/ether (4/5) to give 5 (2.1 g, 36%) as a colorless oil.

Compound 1 was prepared as described above for Compound 5 with the exception of substituting 0.5 molar equivalent of ethyl formate for 3-methylthiopropanal.

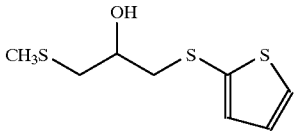

8

Preparation of 2-(2-hydroxy-3-(methylthio) propylthio)thiophene (8)

2-(2',3'-Epoxypropylthio)thiophene (2.5 g, 14.5 mmole) (available from Maybridge Chemicals) was added to a solution of sodium methanethiolate (0.6 g, 5 8.6 mmole) in ethanol (30 mL). The mixture was stirred at room temperature for 16 hours. 2N hydrochloric acid (100 mL) was added and the product was extracted into dichloromethane (100 mL). The organic extracts were dried, filtered, and evaporated and the resulting oil was purified by flash chromatography in dichloromethane to give 8 (0.6 g, 32%) as a colorless oil.

Compound 7 was prepared as described for Compound 8 with the exception of starting from 2-phenylthiomethyloxirane (obtained by the method disclosed in *J. Chem. Soc. Perkin Trans. I,* 1991 p.897).

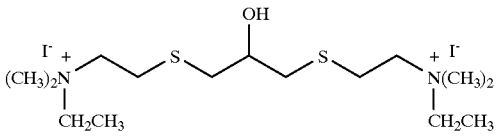

9

Preparation of Compound 9

A solution of Compound 4 (2 g) in acetone (50 mL) under nitrogen at room temperature was treated with ethyl iodide (1.2 mL) by dropwise addition. After continuous stirring for 20 hours, the precipitate that had formed during this period was filtered off, washed with acetone and dried at 40° C. in vacuo to give 2.83 g (65%) of the desired material.

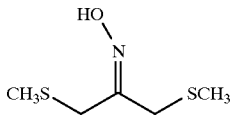

Preparation of Compound 10

A solution of hydroxylamine hydrochloride (5.47 g) and sodium acetate (8.75 g) in water (50 mL) was heated to 40° C. The solution was added to Compound 11 (10 g) in ethanol (100 mL) and the mixture was stirred at 40° C. for 10 minutes. The mixture was cooled and the solvent evaporated. The residue was partitioned between water and ether. The organics were separated, dried, filtered and evaporated to give an oil that was chromatographed in ether:petrol (1:1) to give Compound 10 as an oil (5.64 g, 42%).

EMULSION PREPARATIONS

The following preparations describe the emulsion preparations used Examples 1–4.

Preparation of Emulsion A

This emulsion is a pure silver bromide emulsion of mean grain size 0.11 μm. A kettle solution consisting of 7.9% inert gelatin at pH=3 and pBr 3.05 at 40° C. was prepared. Prenucleation is effected with the addition of 10 mL each of a 3.98 M KBr solution and a 3.84 M AgNO3 solution over 7 seconds. After three minutes the 3.84 M AgNO3 and 3.98 M KBr solutions are added under control pBr with a linear ramp starting at 10 mL per minute and ending at 48 mL per minute after 38 minutes.

Preparation of Emulsion B

This emulsion is a pure silver bromide emulsion of mean grain size 0.16 μm. This emulsion was prepared in an identical way to Emulsion A except that the temperature was increased to 47.5° C. and the silver nitrate was added over 39 minutes 10 seconds.

Preparation of Emulsion C

This emulsion is a pure silver bromide emulsion of mean grain size 0.24 μm. This emulsion was prepared in an identical way to Emulsion A except that the temperature was increased to 58° C. the silver nitrate was added over 58 minutes.

Emulsions A–C were chemically sensitized using N-methylthiosuccinimide and sodium tetrachloroaurate. After sensitization to optimum the emulsions were stabilized by the addition of tetraazaindene. Each emulsion was spectrally sensitized to the infrared part of the spectrum with a heptamethine cyanine dye. The dye was supersensitized by the styrene triazine compound Leucophor BCF (available from Sandoz Company). Prior to coating onto 7 mil polyester, further compounds, such as surfactants and formaldehyde, were added to ensure good coating quality and to harden the gelatin. The gelatin content was adjusted to 90 g/mole prior to coating.

Toning agents as 0.5% solutions in water, methanol, or DMF were added to the emulsion prior to coating. The emulsions were coated at a coating weight of 1.6 gm-2 Ag. The image tone was measured after 30 days of natural aging.

Experimental films described below were tested by exposure to a graduated light source produced by passing the light from a laser diode through a graduated neutral density filter onto the film sample. The exposed film was processed in Kodak RP X-Omat developer (available form Kodak, Rochester, N.Y). The photographic response of the film was measured by scanning the density of the developed image to obtain the usual sensitometric curve. Speed 1 is measured at 1.0 above fog. Image tone was measured using a Transmission Gretag Colorimeter. L*a*b* coordinates were measured at an optical density between 0.90 and 1.10 with the base subtracted. Δb* is defined as:

$$\Delta b^* = b1^* - b0^*$$

where b1* is the b* value of the film containing the additive, with the base subtracted, and b0* is the b* value of the film containing no additive, with the base subtracted.

Example 1

Example 1 illustrates the improvement in image tone observed by the addition of toning compounds to a silver bromide emulsion. Compounds 1–13 were added to emulsion A in the solvent and quantities (mg/mole Ag) listed in Table II. Table II also summarizes the results observed for the change in image tone, together with Dmin and Speed1 for each condition.

TABLE II

| Compound | mg | Solvent | L* | Δb* | Dmin | Speed 1 |
|---|---|---|---|---|---|---|
| control | 0 | none | 37.99 | 0.00 | 0.200 | 2.52 |
| 1 | 274 | MeOH | 37.60 | −2.48 | 0.192 | 2.66 |
| 2 | 269 | MeOH | 37.97 | −2.08 | 0.190 | 2.60 |
| 3 | 900 | MeOH | 39.73 | −1.21 | 0.221 | 1.69 |
| 4 | 875 | MeOH | 38.49 | −2.36 | 0.204 | 2.49 |
| 5 | 640 | MeOH | 37.68 | −2.03 | 0.216 | 2.67 |
| 6 | 348 | MeOH | 37.76 | −2.42 | 0.223 | 2.53 |
| 7 | 710 | MeOH | 38.30 | −2.52 | 0.214 | 2.42 |
| 8 | 725 | MeOH | 38.31 | −1.60 | 0.209 | 2.48 |
| 9 | 762 | Water | 18.60 | −2.40 | 0.202 | 2.55 |
| 10 | 545 | MeOH | 19.26 | −2.40 | 0.199 | 2.61 |
| 11 | 500 | MeOH | 37.91 | −1.76 | 0.207 | 2.36 |
| 12 | 129 | DMF | 37.99 | −1.77 | 0.210 | 2.29 |
| 13 | 500 | MeOH | 37.83 | −1.75 | 0.204 | 2.42 |

All of the compounds gave significant improvements in image tone and in most cases, there was no significant change in Dmin or speed. In some cases, the sensitometry was improved. Although Compound 3 produced a lower speed, it should be emphasized that the loading of the toning agents was not optimized.

Example 2

This example demonstrates that a toning agent can improve the image tone of a range of silver bromide emulsions. Compounds 1–13 were added to emulsion B and C according to the quantities (mg/mole Ag) and in the solvent listed in Table III. Table III also summarizes the image tone and sensitometric properties observed for each respective condition.

TABLE III

| Emulsion | Compound | Solvent | mg | L* | Δb* | Dmin | Speed 1 |
|---|---|---|---|---|---|---|---|
| B | comparison | none | 0 | 36.93 | 0 | 0.198 | 2.93 |
| B | 1 | MeOH | 686 | 37.67 | −1.18 | 0.228 | 2.36 |
| B | 2 | MeOH | 269 | 36.16 | −1.59 | 0.203 | 2.54 |
| B | 3 | MeOH | 635 | 36.70 | −1.51 | 0.215 | 2.24 |
| B | 4 | MeOH | 875 | 38.04 | −2.40 | 0.222 | 2.81 |

TABLE III-continued

| Emulsion | Compound | Solvent | mg | L* | Δb* | Dmin | Speed 1 |
|---|---|---|---|---|---|---|---|
| B | 13 | MeOH | 350 | 37.98 | −0.85 | 0.200 | 3.06 |
| B | 14 | MeOH | 500 | 38.80 | −1.74 | 0.207 | 2.39 |
| B | 15 | MeOH | 592 | 36.87 | −1.22 | 0.217 | 2.32 |
| B | 16 | MeOH | 500 | 38.24 | −0.71 | 0.202 | 2.58 |
| B | 17 | MeOH | 100 | 36.98 | −1.25 | 0.213 | 2.24 |
| B | 18 | water | 100 | 38.52 | −1.13 | 0.208 | 3.01 |
| B | 19 | water | 500 | 38.06 | −0.75 | 0.198 | 3.08 |
| C | comparison | none | 0 | 37.35 | 0 | 0.235 | 3.41 |
| C | 13 | water | 200 | 37.47 | −0.78 | 0.236 | 3.47 |

Example 3

This example demonstrates that a toning agent, over a large range of amounts, can improve the image tone of a of silver bromide emulsions. Toning agent 4, dissolved in methanol, was added to emulsion A. Table IV summarizes the results observed for each of the conditions.

TABLE IV

| Compound | mg | L* | Δb* | Dmin | Speed 1 |
|---|---|---|---|---|---|
| none | 0 | 38.51 | 0 | 0.190 | 2.40 |
| 4 | 175 | 38.09 | −1.66 | 0.195 | 2.49 |
| 4 | 350 | 36.75 | −2.51 | 0.202 | 2.48 |
| 4 | 875 | 38.49 | −2.36 | 0.204 | 2.49 |
| 4 | 1750 | 39.36 | −1.78 | 0.212 | 2.39 |

Example 4

Example compares the inventive compounds with toning agents used in the prior art. The toning compounds were added to emulsion B in the quantities listed in Table V. Table V also summarizes the image tone and sensitometric properties observed for each condition. Comparative compounds 20 and 21 are commercially available compounds having the following chemical structures:

TABLE V

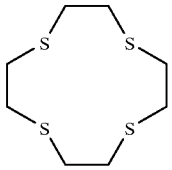

20

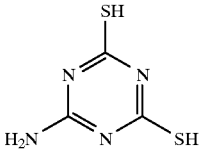

21

| Compound | mg | Solvent | L* | Δb* | Dmin | Speed1 |
|---|---|---|---|---|---|---|
| none | 0 | none | 36.93 | 0 | 0.198 | 2.93 |
| 4 | 175 | MeOH | 37.21 | −0.90 | 0.210 | 2.92 |
| 4 | 350 | MeOH | 36.53 | −1.72 | 0.210 | 2.89 |
| 4 | 433 | MeOH | 38.04 | −2.40 | 0.208 | 2.81 |
| 4 | 875 | MeOH | 37.53 | −1.52 | 0.222 | 2.81 |
| 20(comparison) | 100 | DMF | 37.40 | −1.17 | 0.195 | 2.31 |

TABLE V-continued

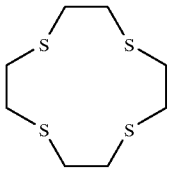

20

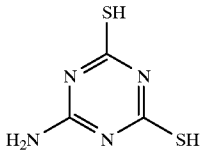

21

| Compound | mg | Solvent | L* | Δb* | Dmin | Speed1 |
|---|---|---|---|---|---|---|
| 20(comparison) | 200 | DMF | 37.11 | −0.50 | 0.195 | 2.04 |
| 20(comparison) | 500 | DMF | 100.00 | 0 | 0.195 | 0 |
| 21(comparison) | 100 | DMF | 37.42 | −1.42 | 0.198 | 2.18 |
| 21(comparison) | 200 | DMF | 37.97 | 0.06 | 0.199 | 1.66 |
| 21(comparison) | 500 | DMF | 37.50 | −0.36 | 0.207 | 1.43 |

The condition using compound 4 improves the image tone without significantly effecting the sensitometry; whereas, the comparative conditions using compounds 20 and 21, while improving the image tone, decrease the speed of the emulsion profoundly.

We claim:

1. A black-and-white, negative-acting silver halide photographic emulsion comprising a dithio substituted toning agent having the following formula:

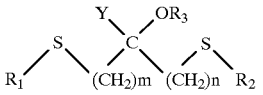

wherein $R_1$ and $R_2$, independently, are selected from the group consisting of alkyl, aryl and heterocyclic groups;

n is an integer from 1 to 5;

m is an integer from 1 to 5;

Y is a hydrocarbon; and $R_3$ is a hydrogen or alkyl group.

2. The emulsion of claim 1 wherein said emulsion comprises at least 50 mole % silver bromide.

3. The emulsion of claim 1 wherein said emulsion comprises at least 75 mole % silver bromide.

4. The emulsion of claim 1 wherein said emulsion comprises from 85 to 100 mole % silver bromide.

5. The emulsion of claim 1 wherein n and m are integers from 1 to 3.

6. A black-and-white, negative-acting silver halide photographic emulsion comprising a dithio substituted toning agent having the following formula:

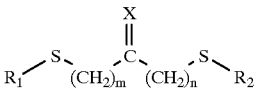

wherein $R_1$ and $R_2$, independently, are selected from the group consisting of alkyl, aryl, and heterocyclic groups;

n and m are integers from 1 to 5; and

X is selected from the group consisting of O, S, —OH, and N—N(R)$_2$, wherein R is a hydrogen or alkyl group.

7. The emulsion of claim 6 wherein said emulsion comprises at least 50 mole % silver bromide.

8. The emulsion of claim 6 wherein said emulsion comprises at least 75 mole % silver bromide.

9. The emulsion of claim 6 wherein said emulsion comprises from 85 to 100 mole % silver bromide.

10. The emulsion of claim 6 wherein n and m are integers from 1 to 3.

11. A black-and-white, negative-acting silver halide photographic element having improved image tone comprising a support having coated thereon at least one layer comprising a silver halide photographic emulsion comprising a dithio substituted toning agent having the following formula:

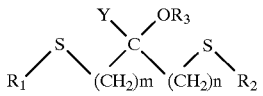

wherein $R_1$ and $R_2$, independently, are selected from the group consisting of alkyl, aryl and heterocyclic groups;

n is an integer from 1 to 5;

m is an integer from 1 to 5;

Y is a hydrocarbon; and $R_3$ is a hydrogen or alkyl group.

12. The photographic element of claim 11 wherein said emulsion comprises at least 50 mole % silver bromide.

13. The photographic element of claim 11 wherein said emulsion comprises at least 75 mole % silver bromide.

14. The photographic element of claim 11 wherein said emulsion comprises from 85 to 100 mole % silver bromide.

15. A black-and-white, negative-acting photographic element having improved image tone comprising a support having coated thereon at least one layer comprising a silver halide photographic emulsion comprising a dithio substituted toning agent having the following formula:

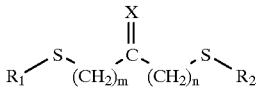

wherein $R_1$ and $R_2$, independently, are selected from the group consisting of alkyl, aryl, and heterocyclic groups;

n and m are integers from 1 to 5; and

X is selected from the group consisting of O, S, —OH, and N—N(R)$_2$, wherein R is a hydrogen or alkyl group.

16. The photographic element of claim 15 wherein said emulsion comprises at least 50 mole % silver bromide.

17. The photographic element of claim 15 wherein said emulsion comprises at least 75 mole % silver bromide.

18. The photographic element of claim 15 wherein said emulsion comprises from 85 to 100 mole % silver bromide.

19. A black-and-white, negative-acting silver halide photographic emulsion comprising a dithio substituted toning agent having the following formula:

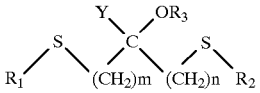

wherein $R_1$ and $R_2$, independently, are selected from the group consisting of alkyl, aryl and heterocyclic groups, or $R_1$ and $R_2$ together form a cyclic compound selected from the group consisting of 1,5-dithicyclooctane and 1,5, 9, 13-tetrathiacyclohexadecane;

n is an integer from 1 to 5;

m is an integer from 1 to 5;

Y is a hydrocarbon; and $R_3$ is a hydrogen or alkyl group.

* * * * *